US011105303B2

(12) United States Patent
Sugihara

(10) Patent No.: US 11,105,303 B2
(45) Date of Patent: Aug. 31, 2021

(54) EGR VALVE

(71) Applicant: AISAN KOGYO KABUSHIKI KAISHA, Obu (JP)

(72) Inventor: Koichi Sugihara, Chiryu (JP)

(73) Assignee: AISAN KOGYO KABUSHIKI KAISHA, Obu (JP)

( * ) Notice: Subject to any disclaimer, the term of this patent is extended or adjusted under 35 U.S.C. 154(b) by 0 days.

(21) Appl. No.: 16/739,669

(22) Filed: Jan. 10, 2020

(65) Prior Publication Data

US 2020/0232424 A1 Jul. 23, 2020

(30) Foreign Application Priority Data

Jan. 17, 2019 (JP) ..... JP2019-006427

(51) Int. Cl.

| | |
|---|---|
| ***F02M 26/72*** | (2016.01) |
| ***F02M 26/67*** | (2016.01) |
| ***F02M 26/50*** | (2016.01) |
| ***F02M 26/11*** | (2016.01) |

(52) U.S. Cl.

CPC ..... *F02M 26/72* (2016.02); *F02M 26/11* (2016.02); *F02M 26/50* (2016.02); *F02M 26/67* (2016.02)

(58) Field of Classification Search

CPC ..... F02M 26/72; F02M 26/67; F02M 26/50; F02M 26/11; F02M 26/74; F02M 26/68

See application file for complete search history.

(56) References Cited

U.S. PATENT DOCUMENTS

| | | | | |
|---|---|---|---|---|
| 2,369,025 A * | 2/1945 | Cummings | ..... | F01L 3/22 123/188.8 |
| 4,044,737 A * | 8/1977 | Nishimura | ..... | F02M 26/58 123/568.29 |
| 4,106,449 A * | 8/1978 | Matsumoto | ..... | F02M 26/58 123/568.12 |
| 4,497,335 A * | 2/1985 | Masuda | ..... | F02M 26/55 123/568.29 |

(Continued)

FOREIGN PATENT DOCUMENTS

| | | |
|---|---|---|
| DE | 102011079742 A1 | 1/2013 |
| WO | 2008081622 A1 | 7/2008 |

OTHER PUBLICATIONS

May 26, 2021 Indian Office Action (OA) for Indian Pat. App. No. 202014000942 (5 pages).

*Primary Examiner* — Joseph J Dallo
*Assistant Examiner* — Kurt Philip Liethen
(74) *Attorney, Agent, or Firm* — Shumaker, Loop & Kendrick, LLP

(57) ABSTRACT

An exhaust gas recirculation valve that includes a recirculation passage through which the exhaust gas flows; a valve seat press-fitted onto an inner surface of the recirculation passage; a valve body configured to sit on the valve seat; and a shaft extending through an inside and outside of the recirculation passage and fixed to the valve body and configured to move the valve body relative to the valve seat, in which corrosion-resistant coating is not provided on a portion of the inner surface of the recirculation passage that contacts a peripheral surface of the valve seat, and the corrosion-resistant coating is provided on another portion of the inner surface of the recirculation passage that contacts an end surface of the valve seat in a direction of press-fitting.

9 Claims, 6 Drawing Sheets

(56) References Cited

U.S. PATENT DOCUMENTS

| | | | | |
|---|---|---|---|---|
| 5,685,519 | A * | 11/1997 | Bircann | F16K 31/0655 251/129.15 |
| 6,044,827 | A * | 4/2000 | Pfaff | F02M 26/21 123/568.18 |
| 6,182,684 | B1 * | 2/2001 | Frankenberg | F02M 26/74 137/340 |
| 6,631,707 | B1 * | 10/2003 | Bender | F02M 26/73 123/568.11 |
| 7,213,586 | B2 | 5/2007 | Wilson et al. | |
| 7,992,550 | B2 | 8/2011 | Watanuki et al. | |
| 2003/0089351 | A1 * | 5/2003 | Cook | F02M 26/74 123/568.21 |
| 2010/0065027 | A1 * | 3/2010 | Watanuki | F02M 26/11 123/568.11 |
| 2012/0085328 | A1 * | 4/2012 | Bachmann | F02B 77/02 123/668 |
| 2012/0325183 | A1 * | 12/2012 | Hatano | F16K 41/04 123/568.11 |
| 2017/0234273 | A1 * | 8/2017 | Cao | F02M 26/50 123/190.17 |
| 2020/0232424 | A1 * | 7/2020 | Sugihara | F02M 26/50 |

* cited by examiner

EGR VALVE

CROSS-REFERENCE TO RELATED APPLICATION

This application claims priority to Japanese Patent Application No. 2019-006427 filed on Jan. 17, 2019, the contents of which are hereby incorporated by reference into the present application.

TECHNICAL FIELD

The present disclosure discloses art related to an exhaust gas recirculation (EGR) valve.

BACKGROUND

International Publication No. 2008/081622 describes an EGR valve. The EGR valve is connected to an EGR tube configured to supply exhaust gas of an engine to an intake system (i.e. recirculate the exhaust gas to an intake tube side). The EGR valve is provided with a recirculation passage through which the exhaust gas flows. In International Publication No. 2008/081622, corrosion-resistant coating is provided on a part (e.g., a part at which a flow speed of the exhaust gas is fast) or an entirety of an inner surface of the recirculation passage. Further, in International Publication No. 2008/081622, the corrosion-resistant coating is also provided on a shaft (valve rod) that moves a valve body of the EGR valve. By providing the corrosion-resistant coating inside the recirculation passage, degradation (corrosion) of the recirculation passage is suppressed.

SUMMARY

As mentioned above, the EGR valve in International Publication No. 2008/081622 suppresses the corrosion of the recirculation passage by providing the corrosion-resistant coating in the recirculation passage. However, if the corrosion-resistant coating is provided only at a position that is prone to corrode in the recirculation passage or entirely within the recirculation passage, there may be a new problem that the corrosion of the recirculation passage cannot be sufficiently suppressed or a new issue besides the corrosion may occur. Therefore, further considerations with regard to a position where the corrosion-resistant coating is to be provided and a formation method of the corrosion-resistant coating have been demanded. The present description aims to provide a new EGR valve that has a superior corrosion resistivity.

A first feature disclosed herein is an exhaust gas recirculation (EGR) valve connected to an EGR pipe configured to recirculate exhaust gas of an engine to an intake system and adjust an amount of the exhaust gas supplied to the intake system. The EGR valve may comprise: a recirculation passage through which the exhaust gas flows; a valve seat press-fitted onto an inner surface of the recirculation passage; a valve body configured to sit on the valve seat; and a shaft extending through an inside and outside of the recirculation passage and fixed to the valve body and configured to move the valve body relative to the valve seat, wherein corrosion-resistant coating is not provided on a portion of the inner surface of the recirculation passage that contacts a peripheral surface of the valve seat, and the corrosion-resistant coating is provided on another portion of the inner surface of the recirculation passage that contacts an end surface of the valve seat in a direction of press-fitting.

A second feature disclosed herein is the EGR valve according to the first feature, wherein the valve seat may comprise a first portion press-fitted onto the inner surface of the recirculation passage and a second portion having a longer circumferential length of an outer surface than that of the first portion, the first portion having a first end surface that is an end surface in the direction of press-fitting, and the second portion having a second end surface that is an end surface in the direction of press-fitting, the recirculation passage may comprise a first contact surface that contacts the first end surface and a second contact surface that contacts the second end surface, and the corrosion-resistant coating may be provided on at least one of the first contact surface and the second contact surface.

A third feature disclosed herein is the EGR valve according to the second feature, wherein the corrosion-resistant coating may be provided on both the first contact surface and the second contact surface, and at least one of the corrosion-resistant coating interposed between the first end surface and the first contact surface and the corrosion-resistant coating interposed between the second end surface and the second contact surface may be thinner than the corrosion-resistant coating on another portion.

A fourth feature is the EGR valve according to any one of the first to third features, which further may comprise: a housing communicating with the recirculation passage and supporting the shaft outside the recirculation passage; and a sealer press-fitted onto the housing and sealing a gap between the shaft and the housing, wherein the corrosion-resistant coating may be provided on a part of the housing that ranges from an end of the housing on a recirculation passage side to a point beyond a contact portion between the housing and the sealer.

A fifth feature is an EGR valve connected to an EGR pipe configured to recirculate exhaust gas of an engine to an intake system and adjust an amount of the exhaust gas supplied to the intake system. The EGR valve may comprise: a recirculation passage through which the exhaust gas flows; a valve seat press-fitted onto an inner surface of the recirculation passage; a valve body configured to sit on the valve seat; a shaft extending through an inside and outside of the recirculation passage and fixed to the valve body and configured to move the valve body relative to the valve seat; a housing communicating with the recirculation passage and supporting the shaft outside the recirculation passage; and a sealer press-fitted onto the housing and sealing a gap between the shaft and the housing, wherein a corrosion resistant coating may be provided on a part of the housing that ranges from an end of the housing on a recirculation passage side to a point beyond a contact portion between the housing and the sealer.

A sixth feature is the EGR valve according to the feature 4 or 5, wherein the sealer may comprise an annular metal member and a covering portion covering the annular metal member and having a higher elastic modulus than the housing.

The first feature prevents a failure from occurring inside the EGR valve due to a position (valve seat attaching portion) that contacts the valve seat in the recirculation passage. Specifically, since the corrosion-resistant coating is not provided on a portion of the inner surface of the recirculation passage that contacts the peripheral surface of the valve seat, i.e., not provided on a press-fitted surface onto which the valve seat is press-fitted, detachment of the corrosion-resistant coating from the inner surface of the recirculation passage seat can be prevented when the valve seat is press-fitted. When the corrosion-resistant coating detaches from the inner surface of the recirculation passage, a function of the EGR valve might be impaired due to the detached corrosion-resistant coating. For example, if the detached corrosion-resistant coating adheres to the valve seat, and/or the valve body, sealing of the valve seat and the valve body is lost. In other cases, if the detached corrosion-resistant coating adheres to a shaft, smoothness of a surface of the shaft is impaired, resulting in a failed operation of the shaft. The first feature can prevent the above-mentioned failures. Note that since the press-fitted surface in the recirculation passage is in tight-contact with the valve seat, the press-fitted surface does not contact the exhaust gas. Thus, the press-fitted surface does not corrode due to the exhaust gas.

Further, the first feature can prevent the recirculation passage from corroding from a boundary between a portion of the recirculation passage that contacts the valve seat and a part that does not contact the valve seat, i.e., from a boundary between the valve seat attaching portion and another part than the valve seat attaching portion. For example, if the corrosion-resistant coating is not provided on the valve seat attaching portion in order to prevent the corrosion-resistant coating from being detached accompanying with the press-fitting of the valve seat, there may be a risk that the corrosion-resistant coating is not provided on the part other than the valve seat attaching portion due to manufacturing tolerance upon providing the corrosion-resistant coating. As a result of this, the inner surface of the recirculation passage (the part on which the corrosion-resistant coating is not provided) corrodes. According to the first feature, since the corrosion-resistant coating is provided on the part of the inner surface (mating surface) that contacts the end surface in the press-fitting direction of the valve seat in the recirculation passage, the corrosion-resistant coating is provided surely on the part other than the valve seat attaching portion and the boundary between the valve seat attaching portion and the portion other than the valve seat attaching portion. Note that the corrosion-resistant coating provided on the mating surface does not detach from the inner surface (mating surface) of the recirculation passage because it is compressed only during when the valve seat is being press-fitted.

The first feature has an advantage of being able to prevent the detachment of the corrosion-resistant coating from the mating surface over the configuration of applying the corrosion-resistant coating on the entire surface in the recirculation passage. Further, the first feature has an advantage of being able to prevent the corrosion of the recirculation passage more reliably over the configuration of not providing the corrosion-resistant coating on the valve seat attaching portion in an attempt to cope with the corrosion-resistant coating detachment. Examples of the corrosion-resistant coating include fluorine contained resin, alumite, polyimide, modified epoxy, NiP, plating, and ceramic.

The second feature allows the press-fitted surface (surface that contacts the peripheral surface of the first portion) to be surrounded by two mating surfaces (first contact surface and second contact surface). Boundary portions between the mating surfaces and the press-fitting surface are not exposed in the recirculation passage, by which the corrosion of the recirculation passage can be prevented more reliably.

The third feature enables the first end surface and the first contact surface, as well as the second end surface and the second contact surface to surely contact each other via with the corrosion-resistant coating interposed therebetween in the valve seat attaching portion. For example, if the valve seat is press-fitted onto the valve seat attaching portion under a situation where the a distance in the press-fitting direction between the first end surface and the second end surface is longer than a distance in the press-fitting direction between the first contact surface and the second contact surface, the first end surface and the first contact surface come into contact, but the second end surface and the second contact surface do not come into contact. However, even when the distance between the first end surface and the second end surface is longer than the distance between the first contact surface and the second contact surface for example, the third feature allows the corrosion-resistant coating interposed between the first end surface and the first contact surface to be compressed such that the thickness of the corrosion-resistant coating becomes thinner when the valve body is press-fitted. As a result of this, the second end surface and the second contact surface can come into contact with each other via the corrosion-resistant coating. That is, the third feature allows both pairs of the first end surface and the first contact surface and the second end surface and the second contact surface to contact each other via the corrosion-resistant coating even when a shape of the valve seat attaching portion and/or a shape of the valve seat are offset from designed values (i.e., predicted values that manufactured products are theoretically supposed to have).

The fourth feature can also prevent the corrosion inside the housing that supports the shaft. The sealer provided between the shaft and the housing is arranged typically for the purpose of preventing condensed water generated from the exhaust gas from traveling toward an actuator that moves the shaft, for example. The sealer is press-fitted into the housing. Due to this, in a case where the corrosion-resistant coating is provided on an inner surface of the housing, the corrosion-resistant coating is not provided on the press-fitted surface of the sealer in order to prevent the detachment of the corrosion-resistant coating from the press-fitted surface of the sealer. That is, in the case where the corrosion-resistant coating is provided on the housing inner surface, the corrosion-resistant coating is provided on a recirculation passage side with respect to the press-fitted surface of the sealer. As aforementioned, the sealer provided between the shaft and the housing is arranged for waterproof purpose of the actuator for example. The sealer having such function is typically constituted of elastic body. Due to this, even when the sealer is press-fitted onto the housing inner surface on which the corrosion-resistant coating is provided (even when the corrosion-resistant coating is provided on the press-fitted surface of the sealer), the corrosion-resistant coating does not detach from the press-fitted surface. The fourth feature takes advantage of material quality of the sealer (elastic body), and bothers to provide the corrosion-resistant coating on the press-fitted surface of the sealer so as to prevent the corrosion inside the housing.

Similarly to the fourth feature, the fifth feature can allow the corrosion inside the housing that supports the shaft to be prevented.

The sixth feature can maintain the sealing between the shaft and the housing (i.e., tight contact between the housing and the sealer) while preventing surely the detachment of the corrosion-resistant coating from the press-fitted surface upon when the sealer is being press-fitted.

DETAILED DESCRIPTION

Embodiments (Structures Surrounding Engine)

Figure 1:
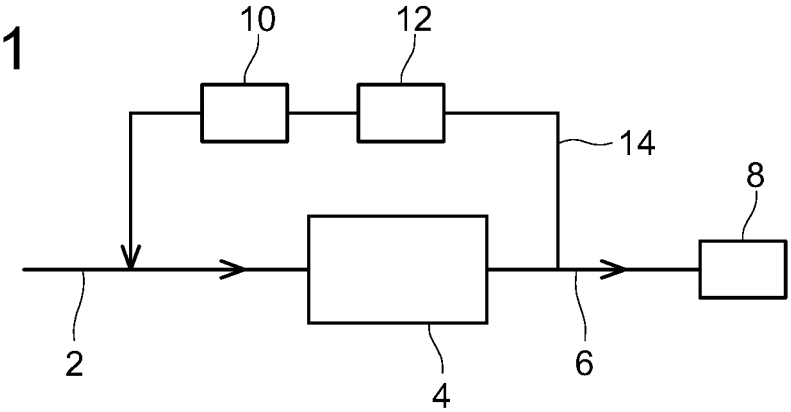
FIG. 1 is a schematic diagram that illustrates a flow of gas passing through an engine.

With reference to FIG. 1, surrounding configurations of an engine (internal combustion engine) 4 will be described. An intake tube 2 configured to introduce atmospheric air is connected to the engine 4. The atmospheric air introduced from the intake tube 2 mixes with fuel supplied from a fuel tank (not shown), and its mixture air is supplied to a combustion chamber of the engine 4. Note that the intake tube 2 is one of components constituting an intake system of a vehicle, and the intake system is configured with other components, besides the intake tube 2, such as an air cleaner (not shown) connected to the intake tube 2 and a throttle valve (not shown) configured to control an opening degree of the intake tube 2, for example. The mixture air which has combusted within the engine 4 is supplied to an exhaust tube 6 as exhaust gas. The exhaust gas has its harmful substance removed (decomposed) therefrom by a catalyst 8, and then discharged to outside air.

An EGR tube 14 is connected to a point between the intake tube 2 and the exhaust tube 6. The EGR tube 14 is provided to recirculate a part of the exhaust gas to the intake tube 2. By recirculating the part of the exhaust gas to the intake tube 2, the harmful substance can be made to burn in the engine 4, and the harmful substance can be reduced. The EGR tube 14 is connected with a cooler 12 and an EGR valve 10. The exhaust gas within the EGR tube 14 is cooled by the cooler 12, and after a flow rate (supply amount) of the exhaust gas is adjusted by the EGR valve 10, the exhaust gas is supplied to the intake tube 2. This means that harmful components which corrode metal, such as sulfated compound and nitric acid compound, flow through the EGR valve 10. The EGR valve 10 has its recirculation passage through which the exhaust gas flows coated with corrosion-resistant coating, and thus the corrosion of the recirculation passage is prevented, details of which will be described below.

(EGR Valve)

Figure 2:
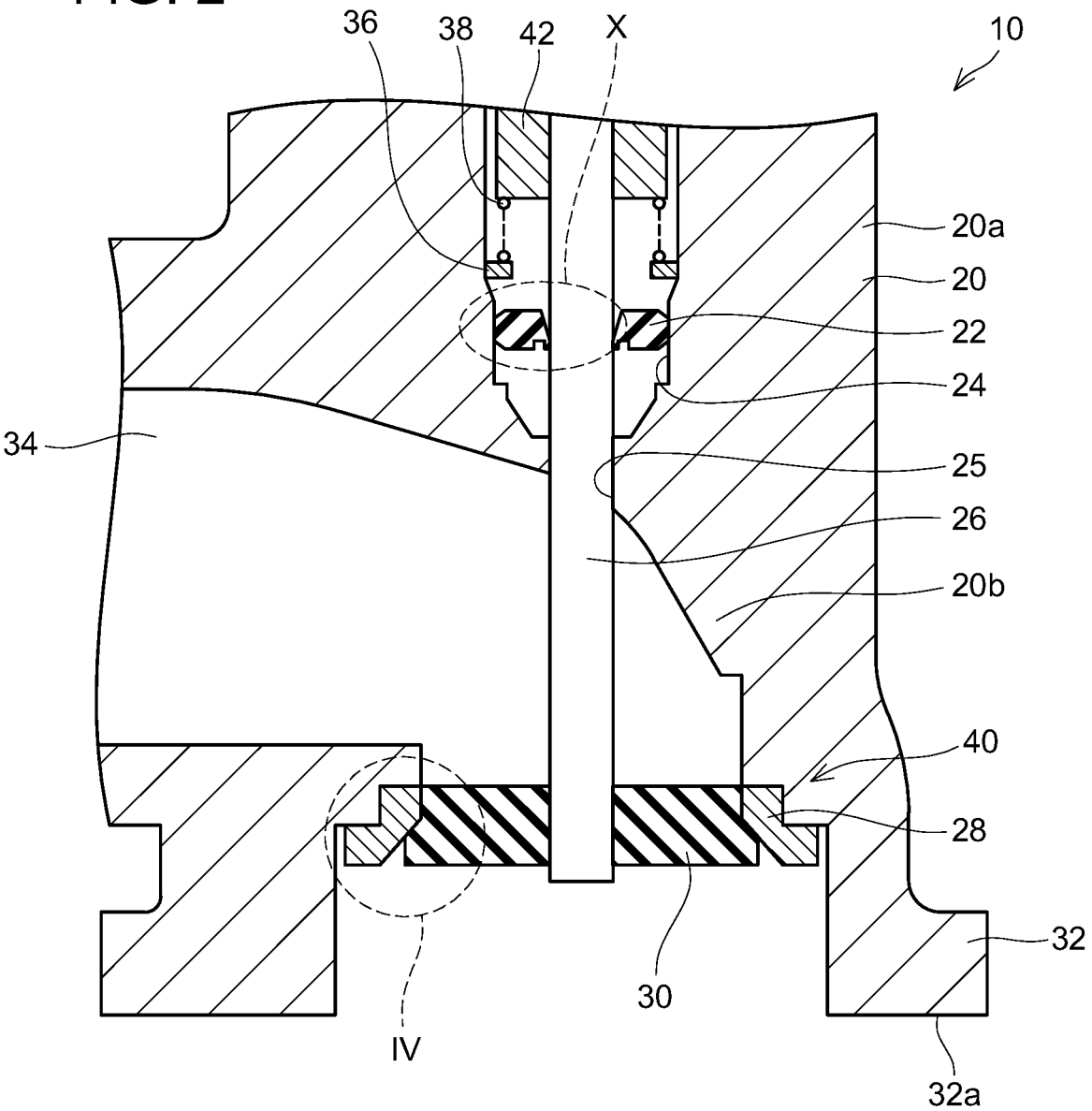
FIG. 2 is a cross-sectional view of an EGR valve according to a first embodiment.
Figure 3:
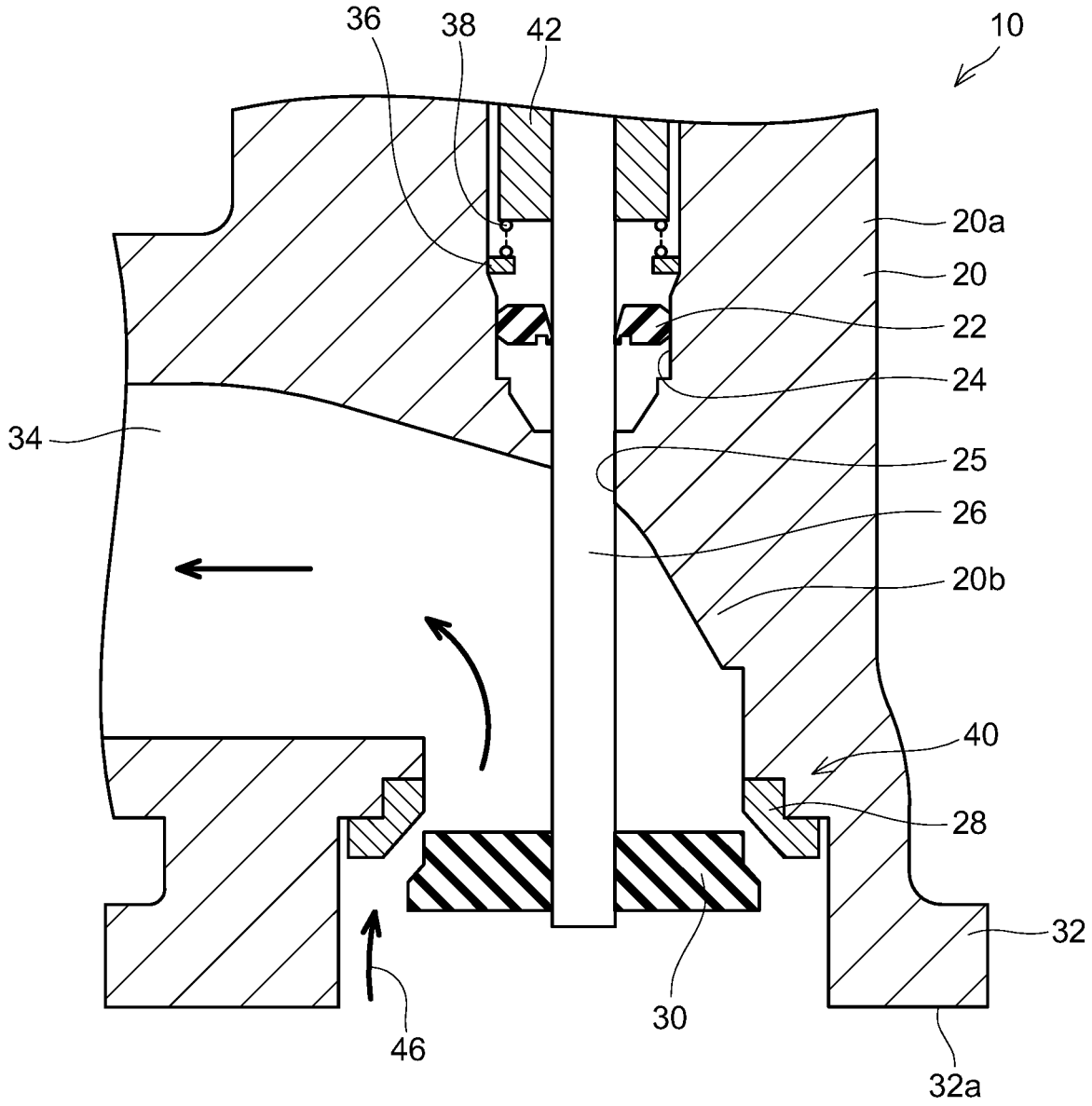
FIG. 3 is a cross-sectional view of the EGR valve according to the first embodiment.

With reference to FIGS. 2 and 3, a structure of the EGR valve 10 will be described. The EGR valve 10 comprises a recirculation passage 34 through which the exhaust gas flows, a valve seat 28 press-fitted onto an inner surface of the recirculation passage 34, a valve body 30 configured to sit on the valve seat 28, a shaft 26 fixed onto the valve body 30, a first housing portion 20*a* supporting the shaft 26 outside the recirculation passage 34, and a sealer 22 sealing a gap between the shaft 26 and the first housing portion 20*a*.

The recirculation passage 34 is constituted by a hole defined in a second housing portion 20*b*. The second housing portion 20*b* is a part of a housing 20, and is molded integrally with the first housing portion 20*a*. That is, of the housing 20, the first housing portion 20*a* supports the shaft 26, the second housing portion 20*b* constitutes the recirculation passage 34 through which the exhaust gas flows. The housing 20 is constituted of aluminum. An inside of the first housing portion 20*a* and an inside of the second housing portion 20*b* are in communication with each other via a communication hole 25. The shaft 26 extends through the communication hole 25 from within the inside of the first housing portion 20*a* to the inside of the second housing portion 20*b* (inside the recirculation passage 34). That is, the shaft 26 extends through the inside of the recirculation passage 34 to an outside of the recirculation passage 34.

Further, the housing 20 comprises a flange 32 for fixing the EGR valve 10 to the EGR tube 14 (see FIG. 1). The flange 32 is disposed an end of the second housing portion 20*b* on an opposite side from the first housing portion 20*a* relative to the second housing portion 20*b*. That is, the flange 32 is disposed on an end of the recirculation passage 34. By fixing the flange 32 to the EGR tube 14 with a coupling surface 32*a* of the flange 32 that contacts a coupling surface of another flange (not shown) provided on the EGR tube 14, a flow path of the exhaust gas inside the EGR tube 14 and the recirculation passage 34 communicate with each other. FIG. 2 illustrates only an upstream portion of the recirculation passage 34. That is, FIG. 2 only illustrates an entrance portion through which the exhaust gas flows from the EGR tube 14 into the EGR valve 10. Although this is not shown, the EGR valve 10 includes another flange for fixing the EGR valve 10 to the EGR tube 14 also at an exit portion (downstream portion of the recirculation passage 34) through which the exhaust gas flows from the EGR valve 10 out to the EGR tube 14.

A wall surface of the recirculation passage 34 (internal wall of the second housing portion 20*b*) includes a valve seat attaching portion 40 for attaching the valve seat 28. The valve seat 28 is an annular ring. The valve seat 28 is press-fitted to the valve seat attaching portion 40 so as to fix the valve seat 28 inside the recirculation passage 34. When the valve body 30 sits on (contacts) the valve seat 28, exhaust gas flow path within the recirculation passage 34 is closed (state shown in FIG. 2). On the other hand, when the valve body 30 separates away from the valve seat 28, the exhaust gas flows inside the recirculation passage 34 as shown by arrows 46 (state shown in FIG. 3), and the exhaust gas is supplied to the intake tube 2 (see FIG. 1). Adjustment of a distance between the valve body 30 and the valve seat 28 (gap between the valve body 30 and the valve seat 28) means adjustment of an amount of the exhaust gas supplied to the intake tube 2. The valve body 30 changes the distance with the valve seat 28 accompanying a movement of the shaft 26. That is, the shaft 26 is fixed to the valve body 30, and moves the valve body 30 with respect to the valve seat 28.

The shaft 26 is supported with a bearing (not shown) by the first housing portion 20*a*. Further, the movement of the shaft 26 is controlled by a spring 38 and an actuator (not shown). Specifically, a first spring holder 42 is fixed to the shaft 26, a second spring holder 36 is fixed to an internal wall 24 of the first housing portion 20*a*, and the spring 38 is disposed between the first spring holder 42 and the second spring holder 36. In this case, while the actuator is not exerting force on the shaft 26, biasing force of the spring 38 causes the valve body 30 to sit on the valve seat 28 (state of FIG. 2), and while the actuator is exerting force on the shaft 26, the spring 38 is compressed and thus the valve body 30 separates away from the valve seat 28 (state of FIG. 3). The actuator is disposed on an end of the shaft 26 (end on an opposite side from the valve body 30).

The sealer 22 is press-fitted to the internal wall 24 of the first housing portion 20*a*. The sealer 22 is an annular ring. The shaft 26 penetrates an inside of the sealer 22. The sealer 22 seals a gap between the shaft 26 and the internal wall 24 of the first housing portion 20*a*, and prevents condensed water generated from the exhaust gas from traveling toward the actuator. The sealer 22 is constituted of metal and resin (elastic body). Details of the sealer 22 will be described below.

Of the EGR valve 10, a coating layer constituted of fluorine resin is provided on an entire surface of the recirculation passage 34, except a part of the valve seat attaching portion 40. The fluorine resin coating layer is an example of corrosion-resistant coating. Further, in the first housing portion 20*a*, the coating layer is provided in a range spanning from an end of the first housing portion 20*a* on a recirculation passage 34 side to a point beyond a contact portion (press-fitted surface of the sealer 22) between the internal wall 24 and the sealer 22. The coating layer is provided inside the communication hole 25 also. Further, the coating layer is provided on the coupling surface 32*a* of the flange 32. As mentioned above, the EGR valve 10 includes not only the flange 32 but also the other flange (not shown) on the downstream side of the recirculation passage 34. The coating layer is provided on a coupling surface of the other flange on the downstream side of the recirculation passage 34. A formation position of the coating layer in the valve seat attaching portion 40 and a formation position of the coating layer in the first housing portion 20*a* will be described below.

(Formation Position of Coating Layer at Valve Seat Attaching Portion)

Figure 4:
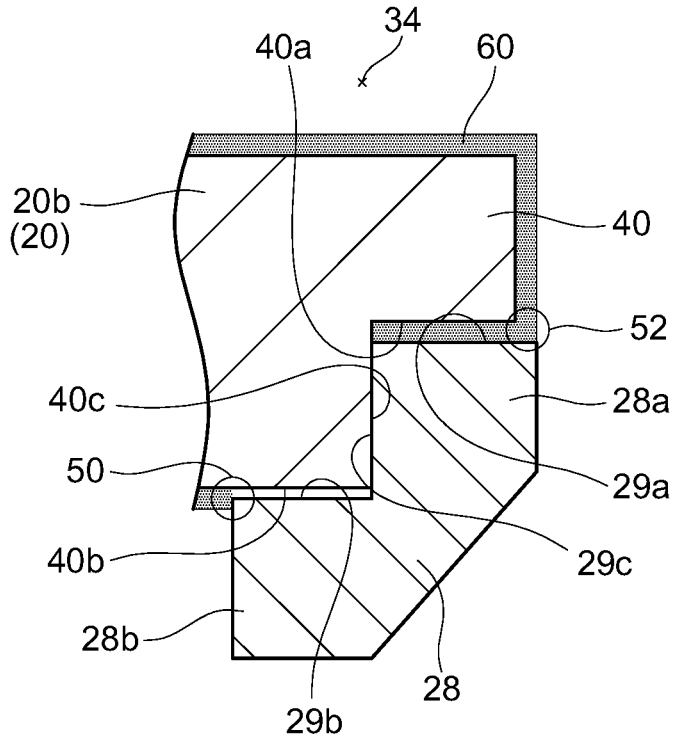
FIG. 4 is an enlarged view of an enclosure IV of FIG. 2.

As shown in FIG. 4, the valve seat attaching portion 40 has the valve seat 28 press-fitted thereto. The valve seat 28 includes a first portion 28*a* press-fitted onto the valve seat attaching portion 40, and a second portion 28*b* having a greater outer radius than that of the first portion 28*a*. That is, a circumferential length of an outer surface of the second portion 28*b* is longer than a circumferential length of an outer surface of the first portion 28*a*. The valve seat attaching portion 40 includes: a first coupling surface 40*a* that contacts a first end surface 29*a* in a press-fitting direction of the first portion 28*a*; a second coupling surface 40*b* that contacts the second end surface 29*b* in the press-fitting direction of the second portion 28*b*; and a press-fitted surface 40*c* onto which the valve seat 28 (first portion 28*a*) is press-fitted. The first coupling surface 40*a* is an example of a first contact surface, and the second coupling surface 40*b* is an example of a second contact surface.

A coating layer 60 is provided on a part of a surface of the valve seat attaching portion 40. Specifically, the coating layer 60 is provided on entireties of the first coupling surface 40*a* and the second coupling surface 40*b*, and the coating layer 60 is not provided on the press-fitted surface 40*c*. Note that in FIG. 4, for description of a state of the coating layer 60 at the valve seat attaching portion 40, the coating layer 60 is depicted to be thicker than its actual thickness. The thickness of the coating layer 60 is adjusted to 80 μm or more for example. In this case, the valve seat attaching portion 40 and the valve seat 28 are manufactured such that a sum of a tolerance of a distance between the first coupling surface 40*a* and the second coupling surface 40*b* of the valve seat attaching portion 40 and a tolerance of a distance between the first end surface 29*a* and the second end surface 29*b* of the valve seat 28 makes 80 μm or less. This enables both the first end surface 29*a* and the second end surface 29*b* to contact the coating layer 60 certainly.

When the valve seat 28 is press-fitted onto the valve seat attaching portion 40, the first end surface 29*a* contacts the first coupling surface 40*a* via the coating layer 60, the second end surface 29*b* contacts the second coupling surface 40*b* via the coating layer 60, and a peripheral surface 29*c* of the first portion 28*a* directly contacts the press-fitted surface 40*c*. This can prevent the surface (internal surface) of the housing 20 constituting the recirculation passage 34 from contacting the exhaust gas.

To summarize the formation positions of the coating layer 60 at the valve seat attaching portion 40, the coating layer 60 is not provided on the surface (press-fitted surface 40*c*) that contacts the peripheral surface (peripheral surface 29*c* of the first portion 28*a*), while the coating layer 60 is provided on the surfaces (coupling surfaces 40*a*, 40*b*) that contact the end surfaces (end surfaces 29*a*, 29*b*) in the press-fitting direction of the valve seat 28. As mentioned above, the coupling surfaces 40*a*, 40*b* that contact the end surfaces 29*a*, 29*b* of the valve seat 28. Therefore, conventionally there is no need to provide the coating layer 60 on the coupling surfaces 40*a*, 40*b*. However, if the coating layer 60 is not provided on the coupling surfaces 40*a*, 40*b*, boundary portions (enclosures 50, 52) between the portion that contacts the valve seat 28 (valve seat attaching portion 40) and the portion that does not contact the valve seat 28 (portion other than the valve seat attaching portion 40) may possibly be exposed in the recirculation passage 34. For example, there may be a risk that manufacturing tolerance upon forming the coating layer 60 inside the housing 20 (second housing portion 20*b*) avoids formation of the coating layer 60 near each of the enclosures 50, 52. In this case, the housing 20 (second housing portion 20*b*) could be exposed in the recirculation passage 34, and could corrode due to an influence of the exhaust gas.

The EGR valve 10 provides the coating layer 60 on the coupling surfaces 40*a*, 40*b* that conventionally do not need the coating layer 60 thereon such that the above-mentioned boundary portions (enclosures 50, 52) are surely covered with the coating layer 60, thereby preventing the housing 20 (second housing portion 20*b*) from being exposed in the recirculation passage 34. Note that formation of the coating layer on the entire surface of the housing (entirety of the inner surface of the recirculation passage including the valve seat attaching portion) results in covering also a part corresponding to the above-mentioned boundary portions with the coating layer. However, in this case, the coating layer is also provided on the press-fitted surface of the valve seat attaching portion, and thus the coating layer provided on the press-fitted surface undesirably detaches when the valve seat is being press-fitted onto the valve seat attaching portion. There is a risk that foreign matters (the detached coating layer) could be incorporated in the recirculation passage, and thus component(s) of the EGR valve could be degraded, and/or the foreign matters could be incorporated into the intake tube (or the engine). The EGR valve 10 can prevent the corrosion of the housing 20 (second housing portion 20*b*) while preventing the foreign matters from being incorporated into the recirculation passage 34.

As shown in FIG. 4, a thickness of the coating layer 60 interposed between the second end surface 29*b* and the second coupling surface 40*b* is thinner than the thickness of the coating layer 60 at other locations. This is not because the coating layer 60 is configured to be thinner only at the spot interposed between the second end surface 29*b* and the second coupling surface 40*b*. This is because the coating layer 60 is compressed upon the valve seat 28 being press-fitted onto the valve seat attaching portion 40, as a result of which the thickness of the coating layer 60 has been thinned as compared to a state of the coating layer 60 before the valve seat 28 being press-fitted onto the valve seat attaching portion 40. By press-fitting the valve seat 28 to the valve seat attaching portion 40 such that the thickness of the coating layer 60 becomes thinner than that before the press-fitting, both the end surfaces 29*a*, 29*b* can be ensured to contact the coupling surfaces 40*a*, 40*b*, respectively. For example, even when there is a discrepancy between a distance in the press-fitting direction between the end surfaces 29*a* and 29*b* and a distance in the press-fitting direction between the coupling surfaces 40*a* and 40*b* due to manufacturing tolerances, both the end surfaces 29*a*, 29*b* can be ensured to contact the coupling surfaces 40*a*, 40*b* (via the coating layer 60), respectively. Note that the thickness of the coating layer 60 between the first end surface 29*a* and the first coupling surface 40*a* may be thinner than the thickness of the coating layer 60 at the other spots, and the thickness of the coating layer 60 between the first end surface 29*a* and the first coupling surface 40*a* and also between the second end surface 29*b* and the second coupling surface 40*b* may be thinner than that at the other spots.

(Variant of Formation Location of Coating Layer)

As mentioned above, in the EGR valve 10, the coating layer 60 is not provided on the press-fitted surface 40*c*, and the coating layer 60 is provided on the coupling surfaces 40*a*, 40*b* in order to prevent the boundary portions between the valve seat attaching portion 40 and the other part besides the valve seat attaching portion 40 from being exposed in the recirculation passage 34. Therefore, the coating layer 60 may not necessarily be provided on the entireties of the coupling surfaces 40*a*, 40*b* so long as the exposure of the above-mentioned boundary portions in the recirculation passage 34 can be prevented. Hereinbelow, with reference to FIGS. 5 to 8, variants of a position at which the coating layer 60 is provided will be described.

Figure 5:
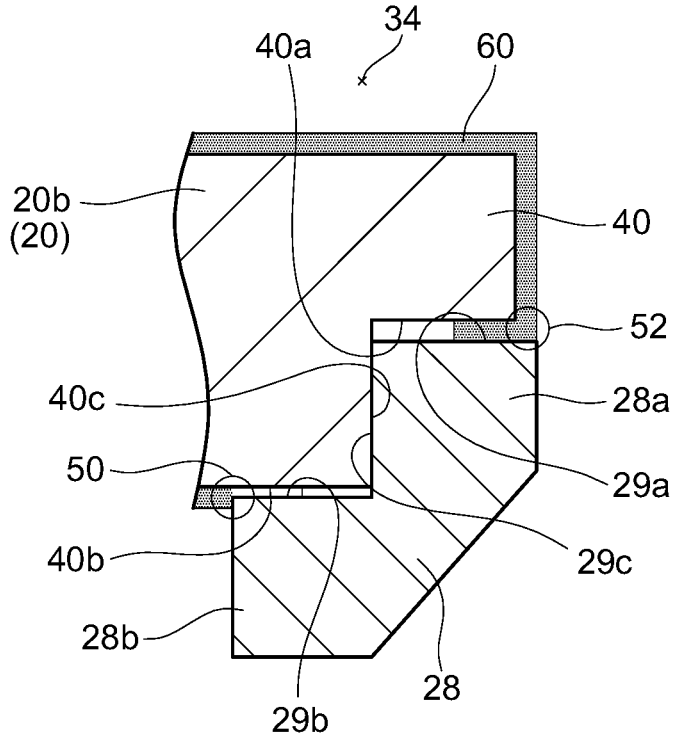
FIG. 5 is a variant of the EGR valve according to the first embodiment.

As shown in FIG. 5, the coating layer 60 may be provided on a part of each of the coupling surfaces 40*a*, 40*b*. To be more precise, the coating layer 60 may be provided on the part of each of the coupling surfaces 40*a*, 40*b* which starts from locations (part besides the valve seat attaching portion 40) where the valve seat 28 and the housing do not contact to a point beyond the boundaries (enclosures 50, 52) between the valve seat attaching portion 40 and the other part besides the valve seat attaching portion 40. Even such a configuration can prevent the above boundaries from being exposed in the recirculation passage 34.

Figure 6:
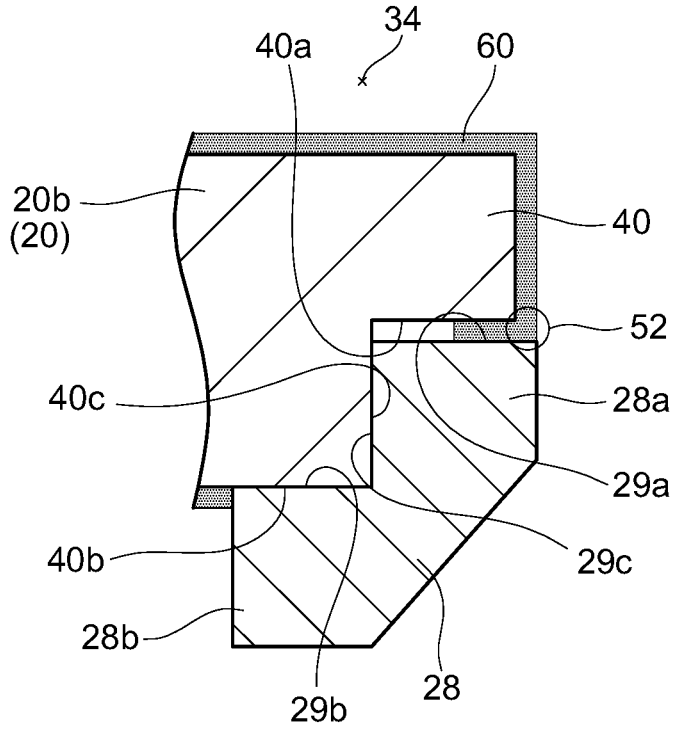
FIG. 6 is a variant of the EGR valve according to the first embodiment.

Further, as shown in FIG. 6, the coating layer 60 may be provided on the first coupling surface 40*a*, and may not be provided on the press-fitted surface 40*c* and the second coupling surface 40*b*. Even in this case, as compared to the configuration where the coating layer 60 is not provided on both the coupling surfaces 40*a*, 40*b*, since the corrosion of the enclosure 52 is prevented, an effect of suppressing the corrosion of the housing 20 can be obtained. Although FIG. 6 illustrates that the coating layer 60 is provided on a part of the first coupling surface 40*a*, the coating layer 60 may be provided on an entirety of the first coupling surface 40*a*.

Figure 7:
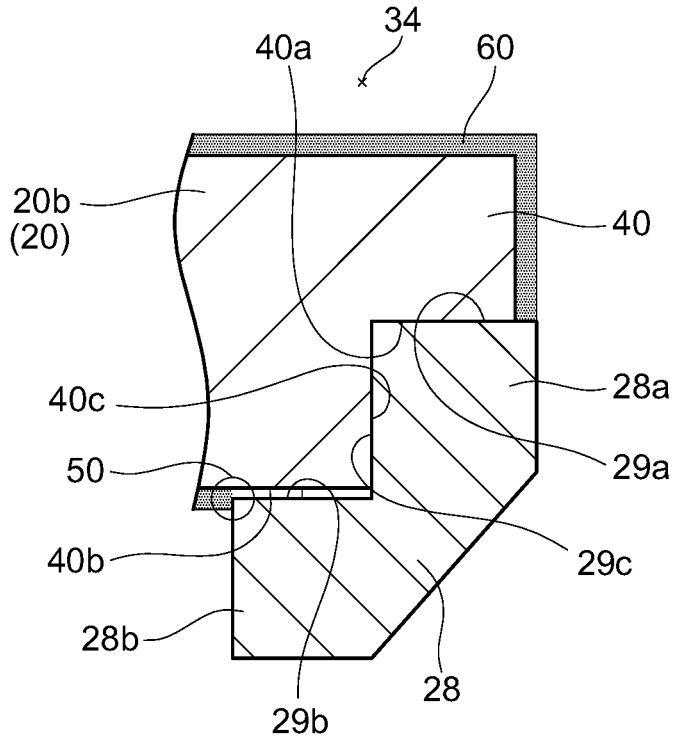
FIG. 7 is a variant of the EGR valve according to the first embodiment.

Further, as shown in FIG. 7, the coating layer 60 may be provided on the second coupling surface 40*b*, and may not be provided on the press-fitted surface 40*c* and the first coupling surface 40*a*. Even in this case also, as compared to the case where the coating layer 60 is not provided on both the coupling surfaces 40*a*, 40*b*, since the corrosion of the enclosure 50 is prevented, the effect of suppressing the corrosion of the housing 20 can be obtained. In FIG. 7, the coating layer 60 is provided on a part of the second coupling surface 40*b*, and however the coating layer 60 may be provided on an entirety of the second coupling surface 40*b*.

Figure 8:
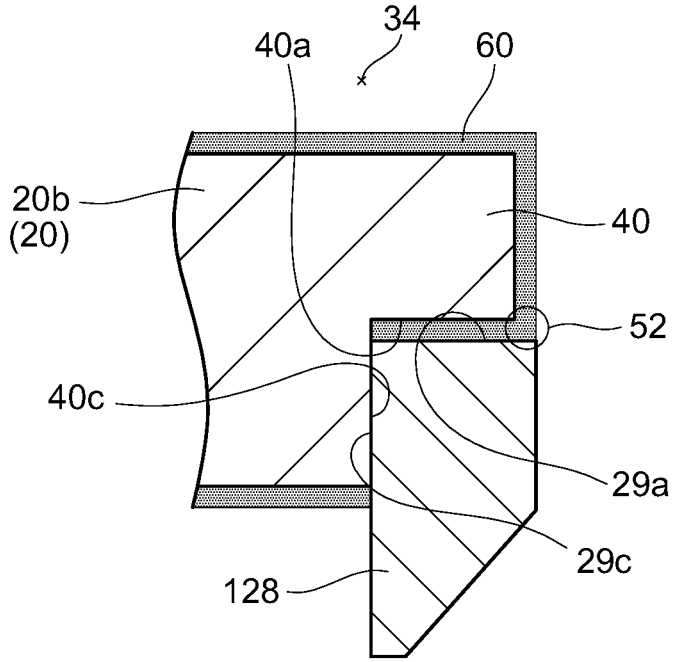
FIG. 8 is a variant of the EGR valve according to the first embodiment.
Figure 9:
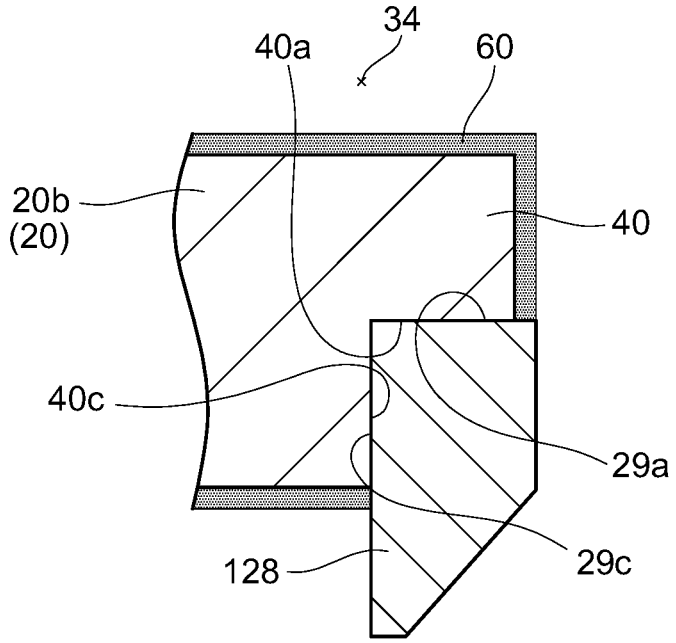
FIG. 9 illustrates a part of a conventional EGR valve that corresponds to the enclosure IV of FIG. 2.

In the configuration depicted in FIG. 8, an outer radius of a valve seat 128 is constant from one end to another end in the press-fitting direction. Due to this, the valve seat 128 contacts the valve seat attaching portion 40 with one surface (the first end surface 29*a*) in the press-fitting direction. In this case also, the coating layer 60 is not provided on a surface (the press-fitted surface 40*c*) that contacts a peripheral surface 29*c* of the valve seat 128, and the coating layer 60 is provided on a surface (the first coupling surface 40*a*) that contacts the end surface (the first end surface 29*a*) of the valve seat 128 in the press-fitting direction. The corrosion near the enclosure 52 can be suppressed by forming the coating layer 60 on the first coupling surface 40*c*, as compared to a state shown in FIG. 9 where the coating layer 60 is not provided on the first coupling surface 40*a*.

(Formation Position of Coating Layer in First Housing)

Figure 10:
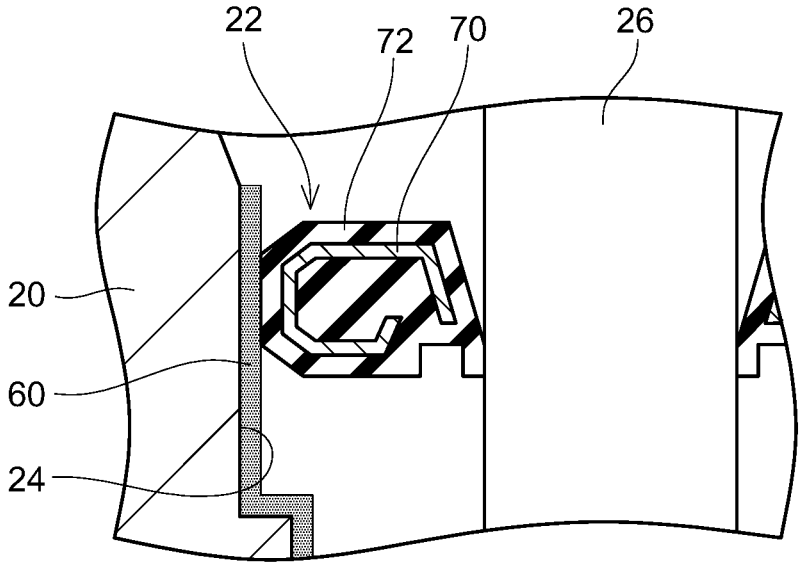
FIG. 10 is an enlarged view of an enclosure X of FIG. 2.

As shown in FIG. 10, the coating layer 60 is also provided in the first housing 20*a* (surface of the internal wall 24). Specifically, the coating layer 60 is provided in a range spanning from the end of the first housing 20*a* on the recirculation passage 34 side to a point beyond the contact portion (press-fitted surface) of the internal wall 24 and the sealer 22. This can prevent the corrosion of the first housing 20*a* even when the exhaust gas flows through the communication hole 25 into the first housing 20*a*. Here, the sealer 22 prevents condensed water generated from the exhaust gas from traveling toward the actuator (not shown).

The sealer 22 is an annular ring. The sealer 22 comprises an annular metal member 70, and a rubber portion 72 covering the metal member 70. That is, the metal member 70 and the rubber portion 72 surrounds an entire circumference of the shaft 26. The rubber portion 72 is an example of a covering portion. A material of the rubber portion 72 is fluoro-rubber, has a higher elastic modulus than the first housing 20*a* (i.e., is more flexible than the first housing 20*a*), and has a superior corrosion-resistivity. The metal member 70 serves to maintain a shape of the sealer 22, i.e., maintain sealing performance between the first housing 20*a* (internal wall 24) and the shaft 26. Further, the rubber portion 72 has a function of sealing a space between the first housing 20*a* and the shaft 26 and preventing the coating layer 60 from detaching from the first housing 20*a* when the sealer 22 is being press-fitted. Thus, even if the sealer 22 is press-fitted into the first housing 20*a*, the coating layer 60 on the press-fitted surface (internal wall 24) does not detach therefrom. Materials of the rubber portion 72 are exemplified as rubber materials such as nitrile rubber, acrylic rubber, and silicon rubber, or resin having a higher elastic modulus than the first housing 20*a* and a higher corrosion-resistivity.

As mentioned above, in the EGR valve 10, the sealer 22 is press-fitted into the first housing 20*a*, and seals the gap between the first housing 20*a* and the shaft 26. Due to this, even when the exhaust gas enters through the communication hole 25 into the first housing 20*a*, the exhaust gas does not go beyond the sealer 22 to further cause another party to travel to the space opposite from the recirculation passage 34 with respect to the sealer 22. This avoids the corrosion of components that control operations of the shaft 26, such as the spring 38 and the actuator, and the part in the first housing 20*a* that is opposite from the recirculation passage 34 with respect to the sealer 22. Further, since the coating layer 60 is provided within the range spanning from the end on the recirculation passage 34 side to beyond the contact portion of the internal wall 24 and the sealer 22, the corrosion of the part on the recirculation passage 34 side with respect to the sealer 22 and of the contact portion with the sealer 22 (press-fitted surface) can also be prevented.

As mentioned above, in the case of the valve seat 28 for example, the coating layer 60 is not provided on the press-fitted surface 40*c* in order to prevent the coating layer 60 from being detached when the valve seat 28 is press-fitted. Conventionally, it has been a general technical common sense that, even for a sealer that seals a space between a shaft and a housing, a coating layer is not provided on a press-fitted surface of the sealer in order to prevent the coating layer from being detached upon when the sealer is press-fitted. Therefore, there had been a part of a housing surface that is not coated with the coating layer on a recirculation passage side with respect to a contact portion of the sealer and the housing. However, in a case of a sealer constituted of an elastic material such as resin, the sealer itself deforms upon being press-fitted so that the coating layer does not detach therefrom. The present description takes advantage of that point, and the EGR valve 10 allows the coating layer 60 to be provided also on the press-fitted surface of the sealer 22, contrary to the conventional technical knowledge, and achieves reliable prevention of the first housing 20*a*.

Other Embodiments

In the above embodiment, the EGR valve was described which comprises two features: (Feature 1) in the recirculation passage, the corrosion-resistant coating is not provided on the surface that contacts the peripheral surface of the valve seat and the corrosion-resistant coating is provided on the surface that contacts the end surface in the press-fitting direction of the valve seat; and (Feature 2) in the housing supporting the shaft, the corrosion-resistant coating is provided in the range spanning from the end on the recirculation passage side to the point beyond the contact portion between the housing and the sealer. However, the EGR valve may comprise only Feature 1, or only Feature 2. In either case, the corrosion resistivity of the EGR valve can be improved as compared to conventional EGR valves.

Further, each of the outer surface of the sealer and the outer surface of the valve seat may not be circular, but may alternatively be a polygonal shape, or an oval figure for example. Each of the outer surface of the sealer and the outer surface of the valve seat may suitably be modified in accordance with the shape of the housing.

While specific examples of the present disclosure have been described above in detail, these examples are merely illustrative and place no limitation on the scope of the patent claims. The technology described in the patent claims also encompasses various changes and modifications to the specific examples described above. The technical elements explained in the present description or drawings provide technical utility either independently or through various combinations. The present disclosure is not limited to the combinations described at the time the claims are filed. Further, the purpose of the examples illustrated by the present description or drawings is to satisfy multiple objectives simultaneously, and satisfying any one of those objectives gives technical utility to the present disclosure.

What is claimed is:

1. An exhaust gas recirculation (EGR) valve connected to an EGR pipe configured to recirculate exhaust gas of an engine to an intake system and adjust an amount of the exhaust gas supplied to the intake system, the EGR valve comprising:

a recirculation passage through which the exhaust gas flows;

a valve seat press-fitted onto an inner surface of the recirculation passage;

a valve body configured to sit on the valve seat; and a shaft extending through an inside and outside of the recirculation passage and fixed to the valve body and configured to move the valve body relative to the valve seat, wherein corrosion-resistant coating is not provided on a portion of the inner surface of the recirculation passage that contacts a peripheral surface of the valve seat, and the corrosion-resistant coating is interposed between the inner surface of the recirculation passage and the valve seat.

2. The EGR valve according to claim 1, wherein the valve seat comprises a first portion press-fitted onto the inner surface of the recirculation passage and a second portion having a longer circumferential length of an outer surface than that of the first portion, the first portion having a first end surface that is an end surface in the direction of press-fitting, and the second portion having a second end surface that is an end surface in the direction of press-fitting, the recirculation passage comprises a first contact surface that contacts the first end surface and a second contact surface that contacts the second end surface, and the corrosion-resistant coating is provided on at least one of the first contact surface and the second contact surface.

3. The EGR valve according to claim 2, wherein the corrosion-resistant coating is provided on both the first contact surface and the second contact surface, and at least one of the corrosion-resistant coating interposed between the first end surface and the first contact surface and the corrosion-resistant coating interposed between the second end surface and the second contact surface is thinner than the corrosion-resistant coating on another portion.

4. The EGR valve according to claim 3, further comprising:

a housing communicating with the recirculation passage and supporting the shaft outside the recirculation passage; and a sealer press-fitted onto the housing and sealing a gap between the shaft and the housing, wherein the corrosion-resistant coating is provided on a part of the housing that ranges from an end of the housing on a recirculation passage side to a point beyond a contact portion between the housing and the sealer.

5. The EGR valve according to claim 4, wherein the sealer comprises an annular metal member and a covering portion covering the annular metal member and having a higher elastic modulus than the housing.

6. An exhaust as recirculation (EGR) valve connected to an EGR pipe configured to recirculate exhaust gas of an engine to an intake system and adjust an amount of the exhaust gas supplied to the intake system, the EGR valve comprising:

a recirculation passage through which the exhaust gas flows;

a valve seat press-fitted onto an inner surface of the recirculation passage;

a valve body configured to sit on the valve seat; and a shaft extending through an inside and outside of the recirculation passage and fixed to the valve body and configured to move the valve body relative to the valve seat, a housing communicating with the recirculation passage and supporting the shaft outside the recirculation passage; and a sealer press-fitted onto the housing and sealing a gap between the shaft and the housing, wherein corrosion-resistant coating is not provided on a portion of the inner surface of the recirculation passage that contacts a peripheral surface of the valve seat, the corrosion-resistant coating is provided on another portion of the inner surface of the recirculation passage that contacts an end of surface of the valve seat in a direction of press-fitting, and the corrosion-resistant coating is provided on a part of the housing that ranges from an end of the housing on a recirculation passage side to a point beyond a contact portion between the housing and the sealer.

7. The EGR valve according to claim 6, wherein the valve seat comprises a first portion press-fitted onto the inner surface of the recirculation passage and a second portion having a longer circumferential length of an outer surface than that of the first portion, the first portion having a first end surface that is an end surface in the direction of press-fitting, and the second portion having a second end surface that is an end surface in the direction of press-fitting, the recirculation passage comprises a first contact surface that contacts the first end surface and a second contact surface that contacts the second end surface, and the corrosion-resistant coating is provided on at least one of the first contact surface and the second contact surface.

8. An EGR valve connected to an EGR pipe configured to recirculate exhaust gas of an engine to an intake system and adjust an amount of the exhaust gas supplied to the intake system, the EGR valve comprising:

a recirculation passage through which the exhaust gas flows;

a valve seat press-fitted onto an inner surface of the recirculation passage;

a valve body configured to sit on the valve seat;

a shaft extending through an inside and outside of the recirculation passage and fixed to the valve body and configured to move the valve body relative to the valve seat;

a housing communicating with the recirculation passage and supporting the shaft outside the recirculation passage; and a sealer press-fitted onto the housing and sealing a gap between the shaft and the housing, wherein a corrosion resistant coating is provided on a part of the housing that ranges from an end of the housing on a recirculation passage side to a point beyond a contact portion between the housing and the sealer.

9. The EGR valve according to claim 8, wherein the sealer comprises an annular metal member and a covering portion covering the annular metal member and having a higher elastic modulus than the housing.

* * * * *